US005794640A

United States Patent [19]

Jang

[11] Patent Number: 5,794,640

[45] Date of Patent: Aug. 18, 1998

[54] QUICK ASSEMBLY TENT FRAMEWORK

[76] Inventor: Jung-Woo Jang, 53-26 Gamsam-dong, Dalseo-ku, Daegu, Rep. of Korea

[21] Appl. No.: 799,806

[22] Filed: Feb. 13, 1997

[51] Int. Cl.[6] ..... E04H 15/50

[52] U.S. Cl. ..... 135/131; 135/145; 135/147; 135/151; 403/174; 403/178; 52/641; 52/646; 52/655.1

[58] Field of Search ..... 52/646, 641, 109, 52/655.1; 135/145, 147, 151, 128–131; 403/217–219, 326, 329, 174, 178, 102, 113, 117, 231

[56] References Cited

U.S. PATENT DOCUMENTS

| | | | |
|---|---|---|---|
| 595,134 | 12/1897 | Bastide | 403/102 X |
| 3,984,884 | 10/1976 | Spitz | 403/230 X |
| 5,244,001 | 9/1993 | Lynch | 135/103 |
| 5,275,188 | 1/1994 | Tsai | 135/151 X |
| 5,421,356 | 6/1995 | Lynch | 135/151 X |

FOREIGN PATENT DOCUMENTS

| | | | |
|---|---|---|---|
| 2709197 | 9/1977 | Germany | 403/230 |
| 618758 | 8/1980 | Switzerland | 403/230 |

*Primary Examiner*—Robert Canfield

*Attorney, Agent, or Firm*—Griffin, Butler, Whisenhunt & Szipl, LLP

[57] ABSTRACT

A quick assembly tent framework is disclosed. In the framework, each of mounts has a channel type socket. The socket is eccentrically formed on each mount with thick and thin sidewalls being formed on opposite sides of the socket. Each of the thick and thin sidewalls has a hinge bore and a hinge guide depression. Two connection members are attached to both ends of each scissor bar. Each of the connection members is axially slitted to a depth thus forming a channel type slit with resilient sidewalls being formed on opposite sides of the slit. Each of the resilient sidewalls has a boss on its outside surface. The boss is guided by the guide depression and elastically snapped into the hinge bore when each scissor bar is jointed to an associated mount. The framework is easily and quickly assembled or disassembled without using any tools thus being convenient to users.

2 Claims, 10 Drawing Sheets

QUICK ASSEMBLY TENT FRAMEWORK

BACKGROUND OF THE INVENTION

1. Field of the Invention

The present invention relates, in general, to a collapsible framework for tents or canopies and, more particularly, to a structural improvement in such a framework to easily and quickly assemble and disassemble the framework.

2. Description of the Prior Art

As well known to those skilled in the art, a tent or canopy is used for shelter from sunshine or rain or for providing a private space, and thereby is widely used for various applications.

In respect to the above use, tents and canopies require a structure suitable for being easily and quickly pitched or collapsed. The above objects are mainly achieved by improving the structure of a tent or canopy framework.

Typical tent frameworks are referred to, for example, U.S. Pat. No. 4,641,676 (issued Feb. 10, 1987), U.S. Pat. No. 4,779,635 (issued Oct. 25, 1988), U.S. Pat. No. 4,947,884 (issued Aug. 14, 1990) and U.S. Pat. No. 5,244,001 (issued Sep. 14, 1993).

The portable canopy structure disclosed in U.S. Pat. No. '676 has a framework that may be collapsed into a stored state yet which may be expanded and erected for use. The framework includes a plurality of upright support members, the adjacent ones of which are connected by means of scissor assemblies comprising either single or dual scissor units connected in end-to-end relation. A flexible covering extends over the framework. In several of the embodiments, a central support is provided for the covering in the form of a central post so that the covering is supported in a dome-like manner. In another embodiment, no central post structure is shown.

However, a problem experienced by the structures shown in U.S. Pat. No. '676 is that the edge scissor assemblies which extend between adjacent support members are often subjected to lateral forces which tend to decrease their stability. Where the scissor assemblies are connected to each other and to the corner supports, compression mounts were used which, if tightened, inhibited the scissoring action and were subjected to shear forces upon lateral deflection. It was often found that the connecting bolts could be bent or broken by excessive lateral deflections.

Meanwhile, the canopy structure disclosed in U.S. Pat. No. '635 outwardly biases its corner support members so that the framework interconnecting adjacent corner support members is placed in tension as opposed to compression, which is the case in U.S. Pat. No. '676. Nonetheless, the structure shown in U.S. Pat. No. '635 is still subject to improvement in the scissor bar interconnections. Likewise, the structure shown in U.S. Pat. No. '884 while providing a very useful canopy of an auto-erect feature relied on similar scissor bar interconnecting bolts which, while quite workable, had the disadvantages indicated above.

The expandable framework structure disclosed in U.S. Pat. No. '001 is adapted to be folded and stored in a collapsed state and erected in an expanded state on a support surface in order to support a canopy above the support surface. The expandable framework includes a plurality of upright support members each having a bottom end positionable on the support surface and a top end opposite the bottom end. In the collapsed state, the support members are oriented alongside one another but are movable outwardly apart from one another towards the expanded state. In the framework structure, a plurality of edge scissor assemblies form truss members for the expandable framework. A plurality of stationary and slidable mounts are disposed on the upright support members to fasten the edge scissor assemblies to the support members. To this end, each of the mounts have sockets formed therein by spaced-apart facing sidewall portions so that the outer ends of the edge scissor assemblies may be held in respective sockets in close fitted engagement between the facing sidewall portions thereof. The mounts are relatively movable with respect to one another so that the edge scissor assemblies are operative to open or close whereby the framework structure may move between the expanded and contracted states.

However, the framework structure disclosed in U.S. Pat. No. '001 is problematic in that it uses a plurality of fastening pins for pivotally securing the outer end portions of the edge scissor assemblies in the sockets of the mounts. The structure thus always requires a tool such as a screw driver when it is assembled or disassembled. The above structure is thus inconvenient to users.

SUMMARY OF THE INVENTION

It is, therefore, an object of the present invention to provide a quick assembly tent framework in which the above problems can be overcome and which is easily and quickly assembled prior to being erected into an expanded state on a support surface and disassembled prior to being folded into a collapsed state so that it is convenient to users.

In order to accomplish the above object, the preferred embodiment of this invention provides a quick assembly tent framework comprising a plurality of upright support members, a plurality of first and second scissor bars forming separable edge scissor assemblies through a plurality of upper and lower joint mounts and detachably connecting the upright support members together through a plurality of first stationary and slidable mounts, a center post supporting the top center of a flexible covering of a tent and having second stationary and slidable mounts, a plurality of third and fourth scissor bars forming roof scissor assemblies and connecting the second stationary and slidable mounts to the upper and lower joint mounts thus holding the center post, wherein each of the mounts is provided with a channel type socket for holding one end of an associated scissor bar, the socket being eccentrically formed on each mount with thick and thin sidewalls being formed on opposite sides of the socket, the thin sidewall being resilient thus elastically opening the socket when the scissor bar is hinged to the mount, each of the thick and thin sidewalls having a hinge bore and a hinge guide depression, the guide depression extending from an edge of each sidewall to the edge of the hinge bore; and two connection members are attached to both ends of each scissor bar in order to hinge each scissor bar to sockets of associated mounts, each of the connection members being axially slit to a depth thus forming a channel type slit with resilient sidewalls being formed on opposite sides of the slit, each of the resilient sidewalls having a boss on its outside surface, the boss being guided by the guide depression and elastically snapped into the hinge bore when each scissor bar is jointed to an associated mount.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
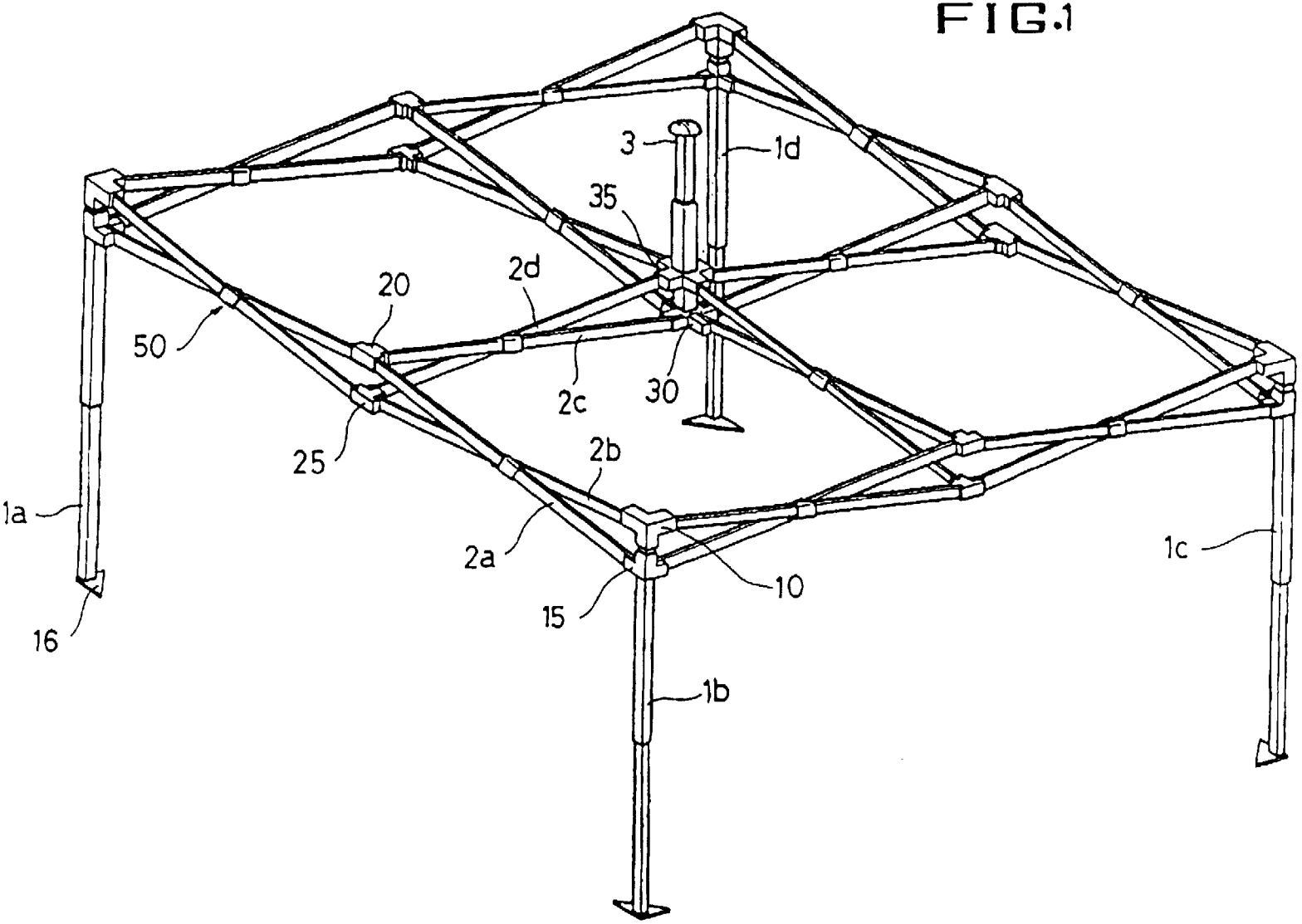
FIG. 1 is a perspective view showing the configuration of a tent framework in a fully-expanded state after being assembled according to the preferred embodiment of this invention.
Figure 2:
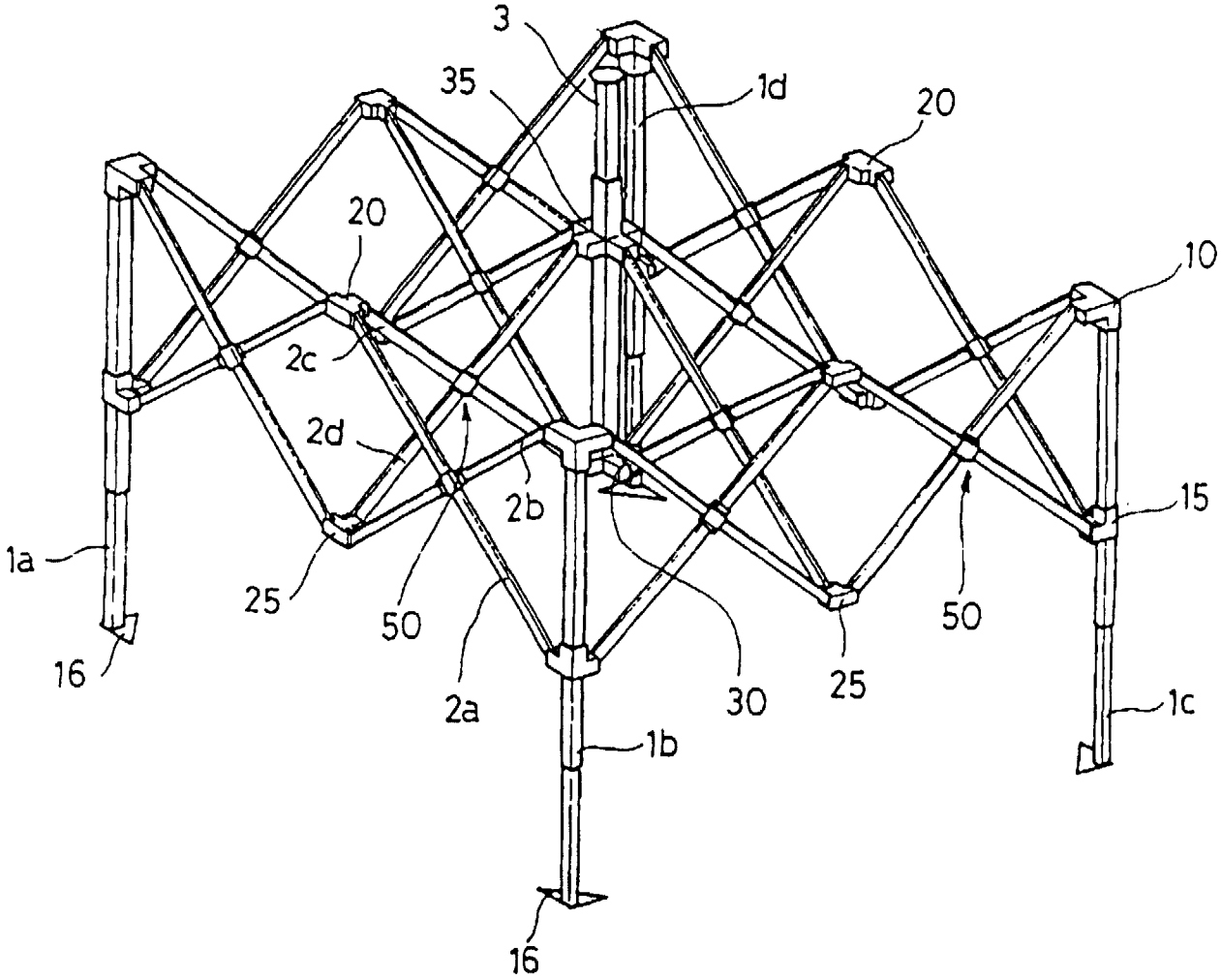
FIG. 2 is a perspective view showing the configuration of the framework of this invention in an initial stage of being folded into a collapsed state.
Figure 3:
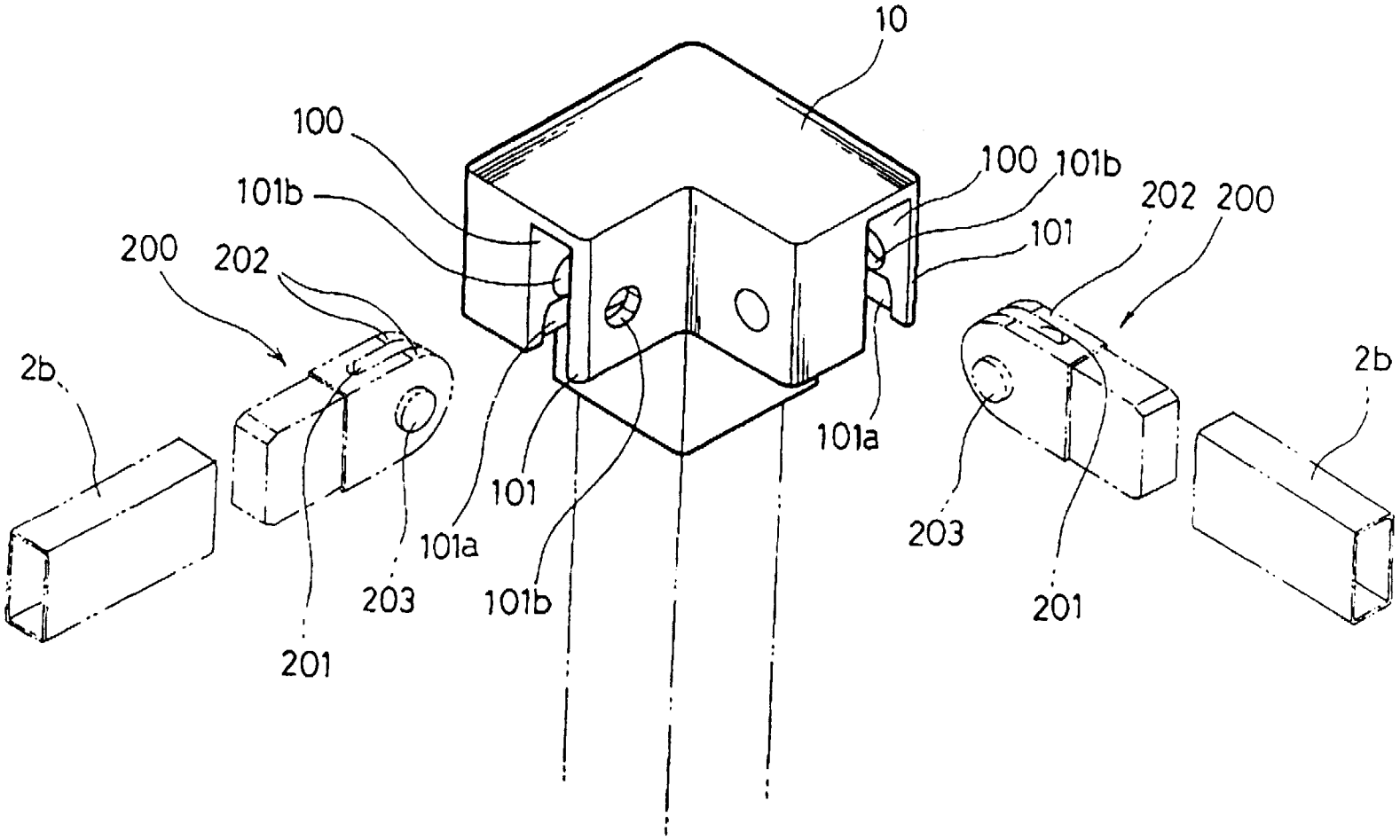
FIG. 3 is an exploded perspective view showing a first stationary mount attached to the top end of an upright support member according to this invention and two scissor bars hinged thereto.
Figure 4:
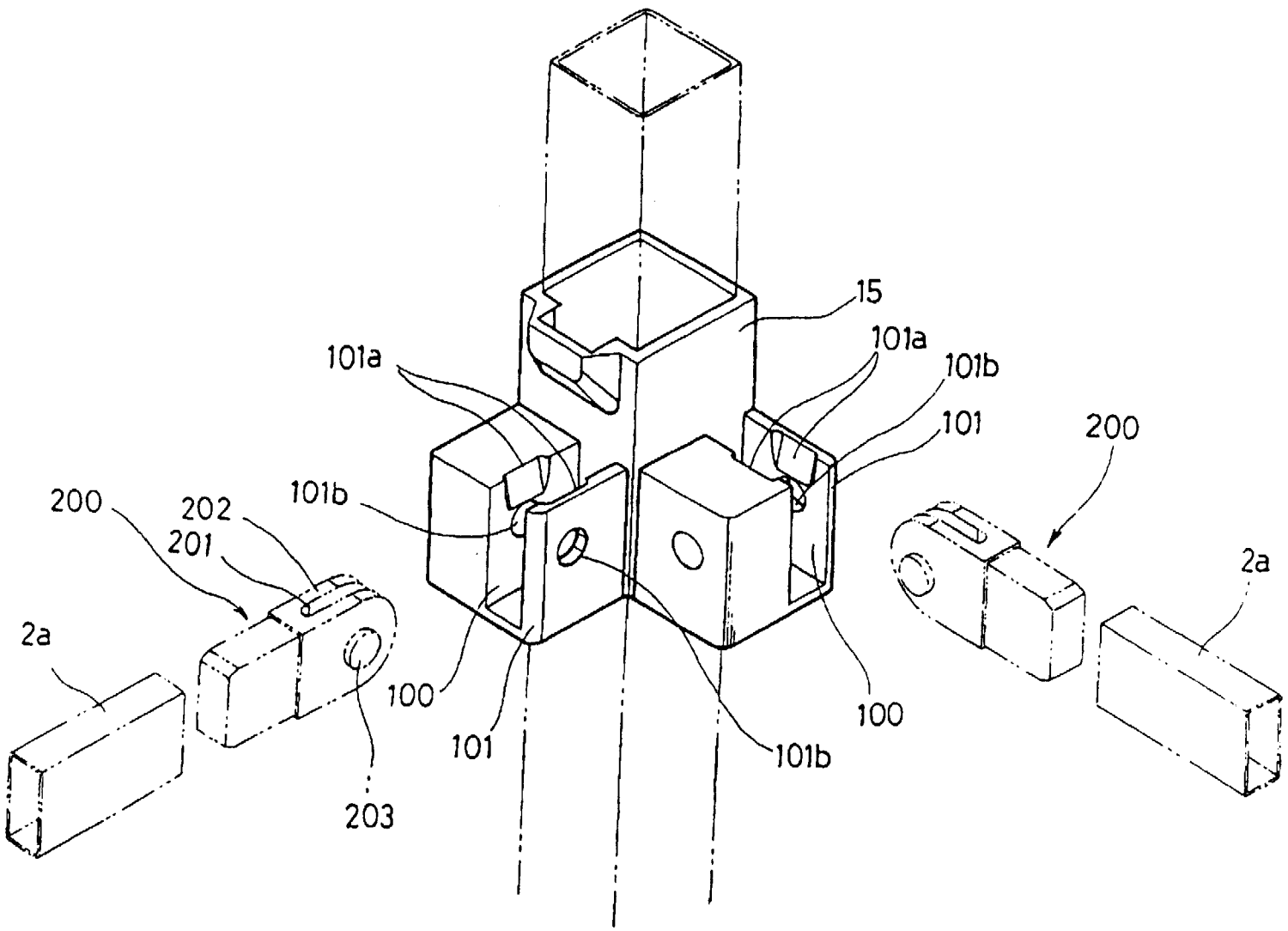
FIG. 4 is an exploded perspective view showing a first slidable mount movably fitted over an upright support member according to this invention and two scissor bars hinged thereto.
Figure 5:
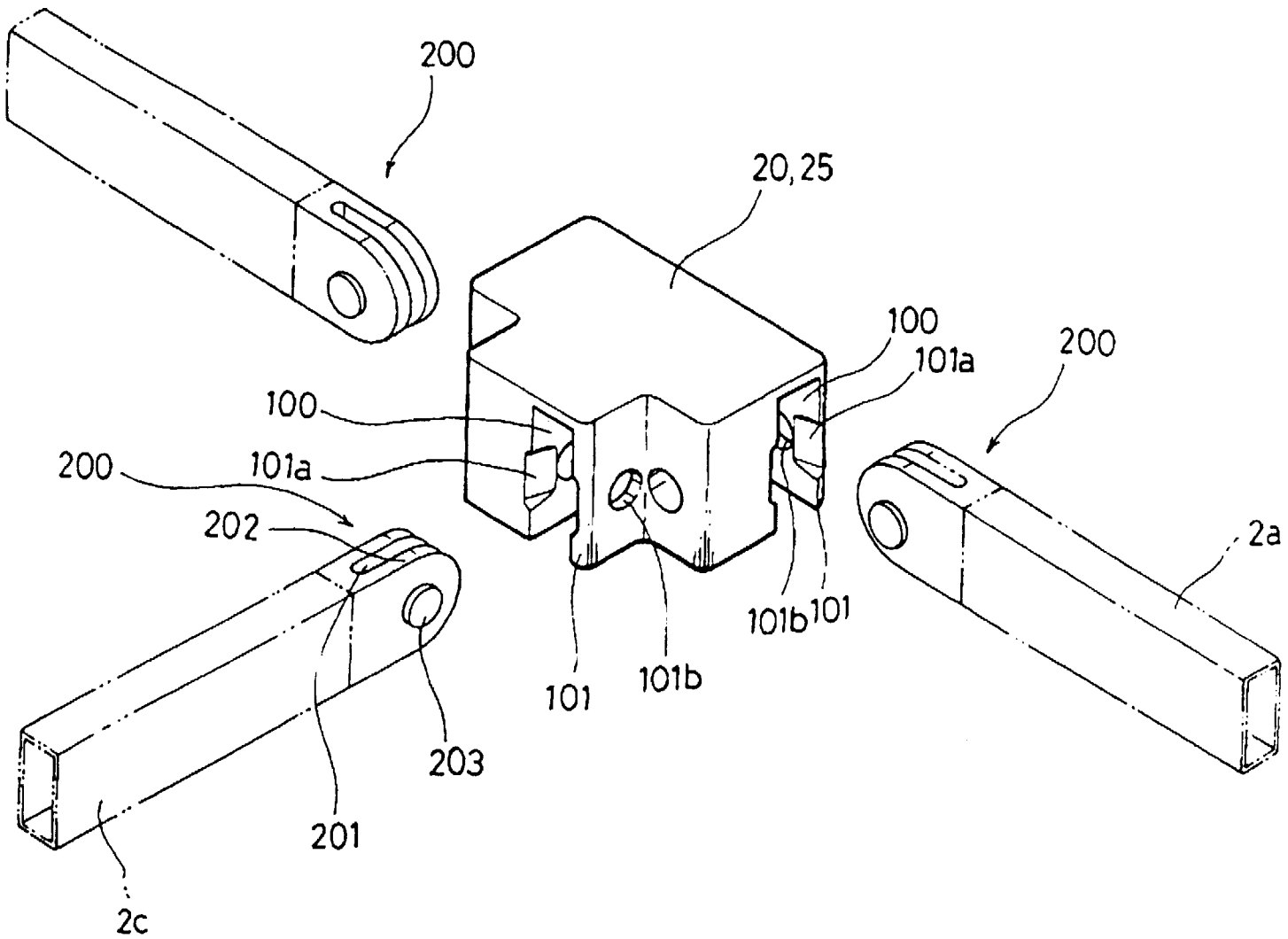
FIG. 5 is an exploded perspective view showing a joint mount of an edge scissor assembly according to this invention and three scissor bars hinged thereto.
Figure 6:
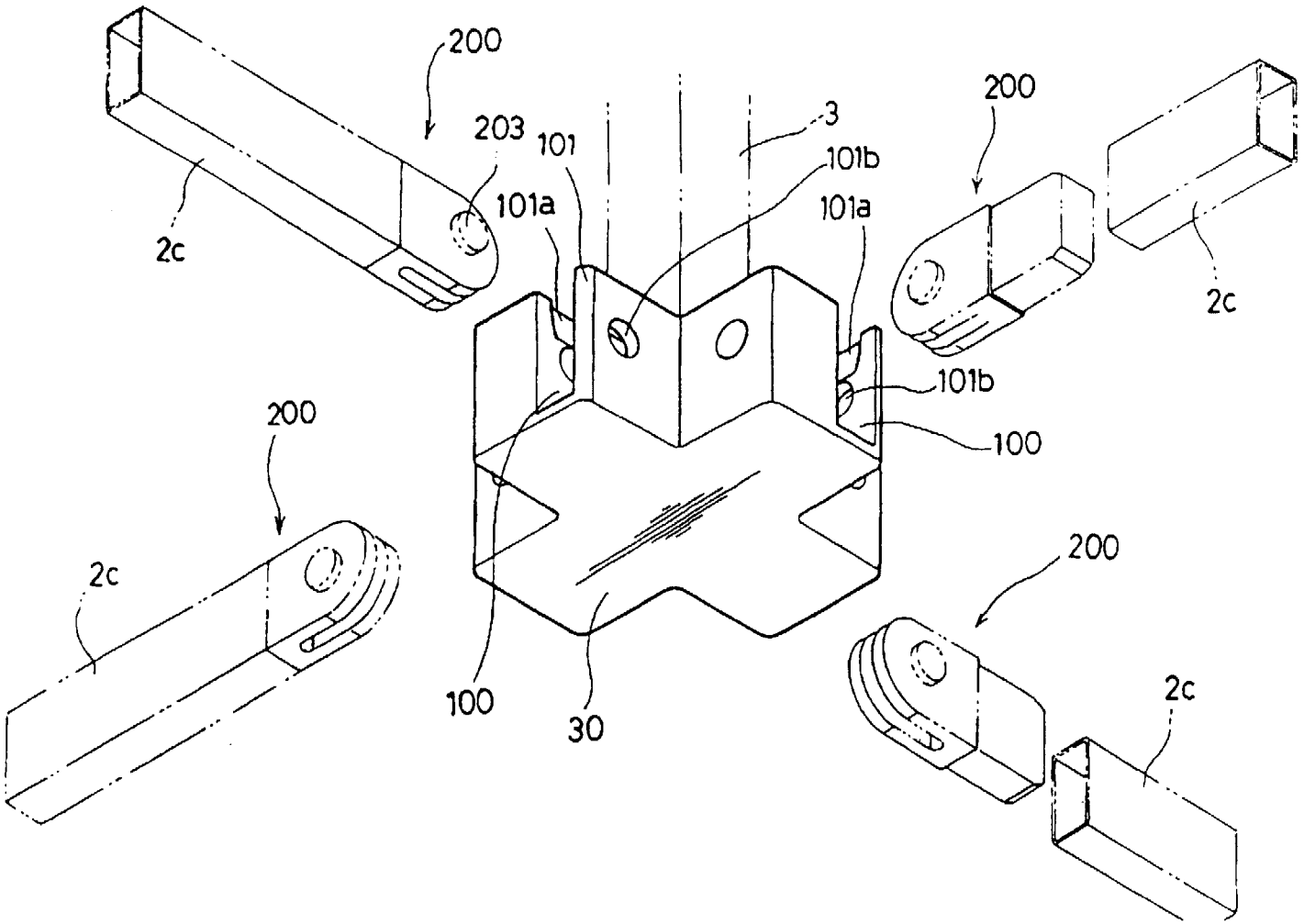
FIG. 6 is an exploded perspective view showing the second stationary mount attached to the bottom end of the center post according to this invention and four scissor bars hinged thereto.
Figure 7:
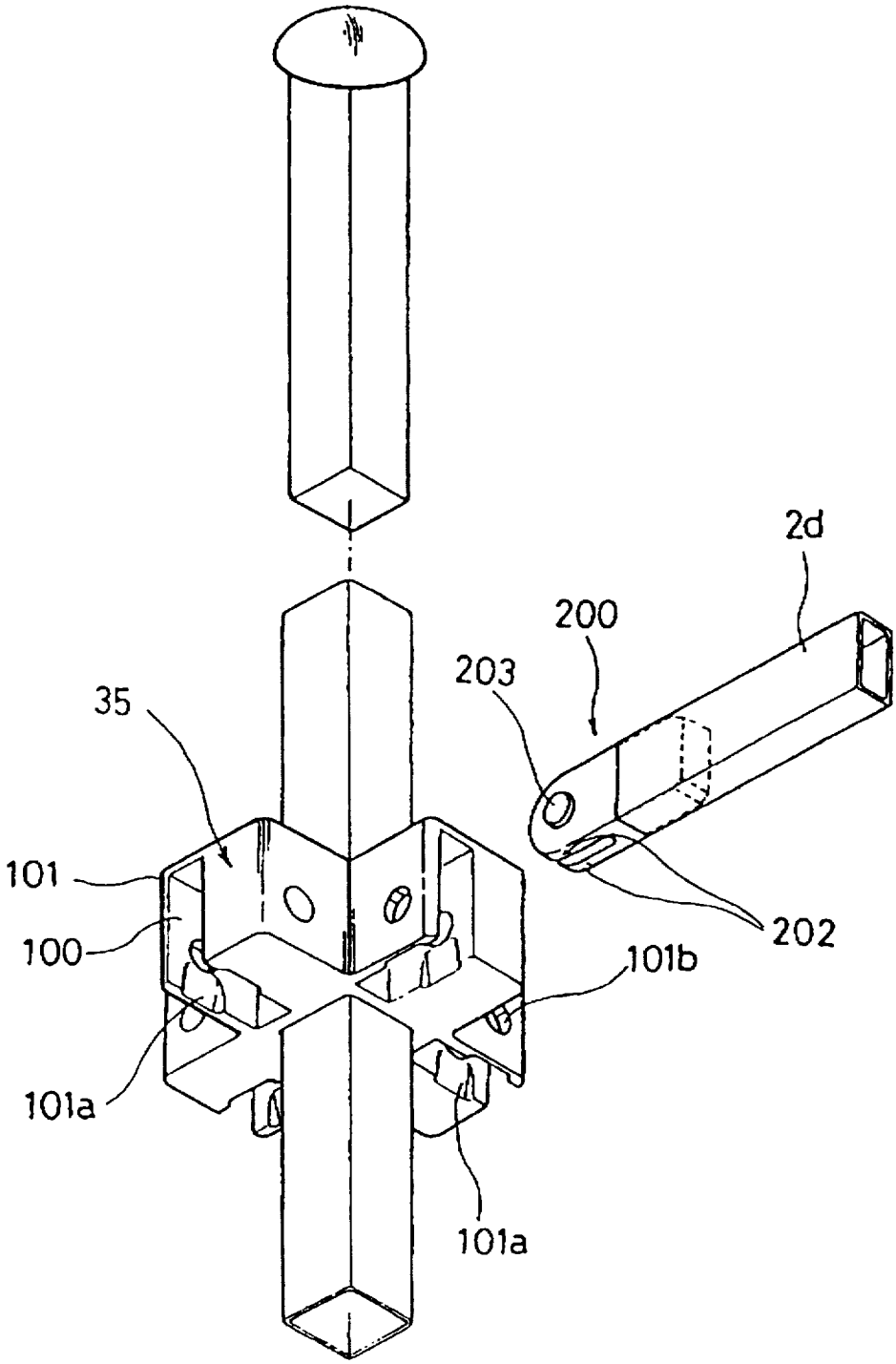
FIG. 7 is an exploded perspective view showing the second slidable mount movably fitted over the center post and four scissor bars hinged thereto.

FIGS. 1 and 2 show the construction and configuration of the quick assembly tent framework in accordance with the preferred embodiment of the invention. As shown in FIGS. 1 and 2, the framework of this invention comprises a plurality of, preferably, four, upright support members 1*a*, 1*b*, 1*c* and 1*d* which form the corner support members of the framework. Each of the above members 1*a* to 1*d* has a telescopic structure thus being height-adjustable and having a holder 16 on its bottom end. The above holder 16 holds the support member on a support surface when the framework is erected into an expanded state.

Attached to the top end of each of the support members 1*a* to 1*d* is a first stationary mount 10. A first slidable mount 15 is movably fitted over each of the support members 1*a* to 1*d* so that the mount 15 may move along the support member between a position proximate the stationary mount 10 and a position remote from the mount 10 when the framework is erected into an expanded state or folded into a collapsed state, respectively. The uppermost and lowermost positions of the slidable mount 15 relative to the support member are limited by the stationary mount 10 and the holder 16, respectively. The first slidable mounts 15 of the four support members 1*a* to 1*d* are connected together through a plurality of first scissor bars 2*a*, while the stationary mounts 10 are connected together through a plurality of second scissor bars 2*b*. The first and second scissor bars 2*a* and 2*b* form edge scissor assemblies which also assemble the four support members 1*a* to 1*d* into a single structure.

That is, a first scissor bar 2*a* is hinged to a first slidable mount 15, while a second scissor bar 2*b* is hinged to a first stationary mount 10. The two scissor bars 2*a* hinged to two adjacent upright support members are in turn joined together by an upper joint mount 20, while the two scissor bars 2*b* hinged to adjacent upright support members are jointed together by a lower joint mount 25. Each first bar 2*a* is also hinged to an associated second bar 2*b* at a hinged joint 50, thus forming an edge scissor assembly. Due to the edge scissor assemblies formed by the bars 2*a* and 2*b*, the four support members 1*a* to 1*d* are assembled into a single structure.

Figure 10:
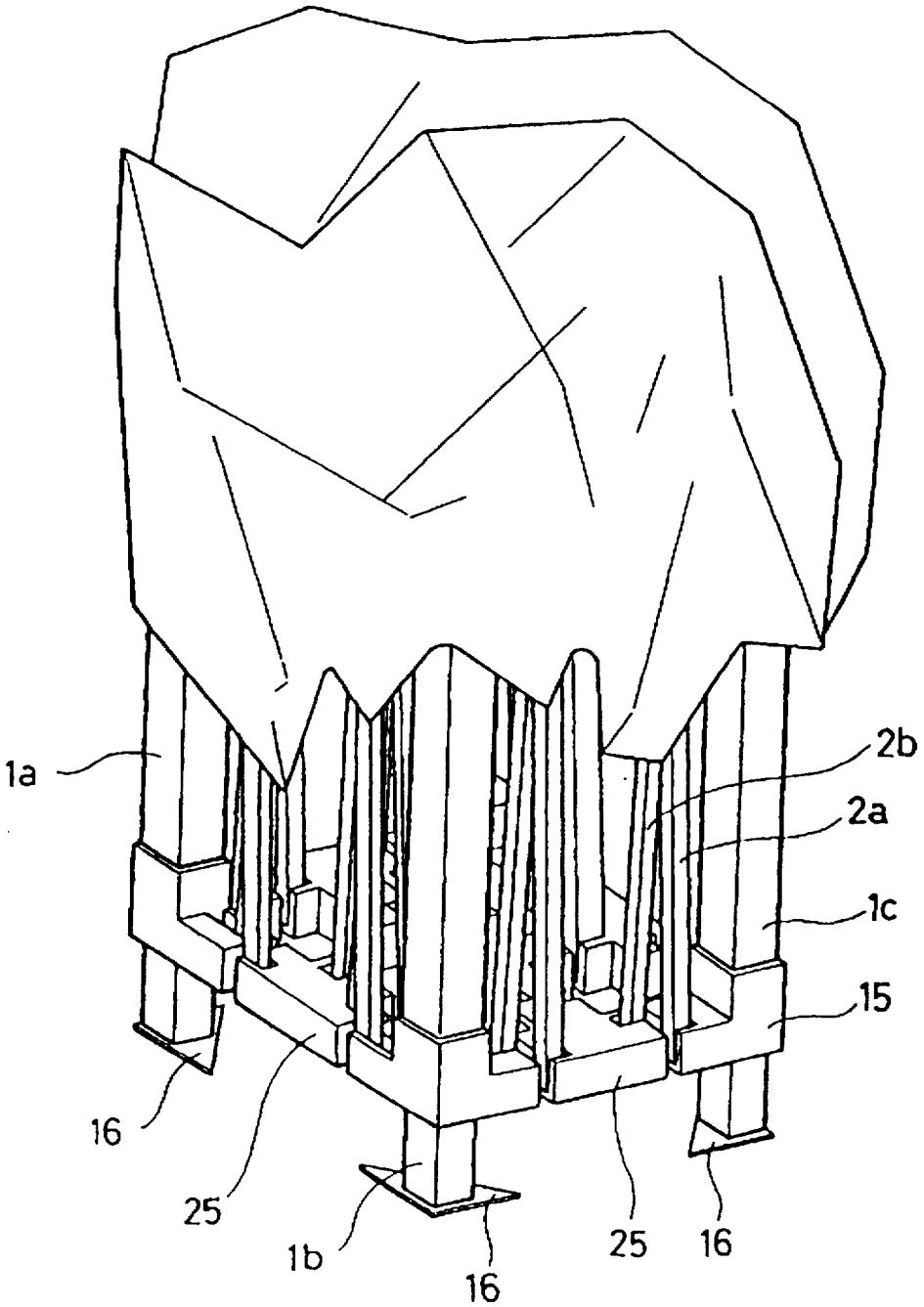
FIG. 10 is a perspective view showing the fully-collapsed framework of this invention having a flexible covering thereon.

The framework also includes a center post 3, which supports the top center of a flexible covering (see FIG. 10) when the framework is fully erected in an expanded state on a support surface. A second stationary mount 30 is attached to the bottom end of the center post 3 and is commonly connected to the four upper joint mounts 20 through a plurality of third scissor bars 2*c*. Meanwhile, a second slidable mount 35 is movably fitted over the center post 3 at a position above the second stationary mount 30 and is commonly connected to the four lower joint mounts 25 through a plurality of fourth scissor bars 2*d* thus holding the center post 3.

Each of the third scissor bars 2*c* is also hinged to an associated fourth scissor bar 2*d* at a hinged joint 50 thus forming a roof scissor assembly.

When the framework is folded from the fully-expanded state into the collapsed state, the four upright support members 1*a* to 1*d* come together while lowering the center post 3 as shown in FIG. 2, so that the framework can be fully folded with a minimized volume. Meanwhile, when the framework is erected from the collapsed state into the expanded state, the four support members 1*a* to 1*d* are moved to the positions remote from each other while raising the center post 3 thus bringing the framework into the expanded state as shown in FIG. 1.

While designing the framework of this invention, it is a most important factor to appropriately design the interconnecting structure between the mounts 10, 15, 20, 25, 30 and 35, the four support members 1*a* to 1*d*, the scissor bars 2*a* to 2*d* and the center post 3. The interconnecting structure will be described in detail hereinbelow.

As shown in FIGS. 3 to 7, each of the mounts 10, 15, 20, 25, 30 and 35 has at least two lobes, each of which is provided with a channel type socket 100 for holding one end of an associated scissor bar 2*a*, 2*b*, 2*c*, or 2*d*. The above socket 100 is eccentrically formed on each lobe of the mount, with thick and thin sidewalls being formed on opposite sides of the socket 100. In each lobe of a mount, the thin sidewall 101 is resilient so that the socket 100 may be elastically opened when an associated scissor bar is inserted into and assembled with the socket 100. The thick and thin sidewalls of each mount are provided with respective bores 101*b*. The inside surface of each sidewall is partially depressed, thus forming a guide depression 101*a* which extends from an edge of the sidewall to the edge of an associated bore 101*b* and guides a boss of a scissor bar into the bore 101*b* when the bar is hinged to the mount.

Figure 8:
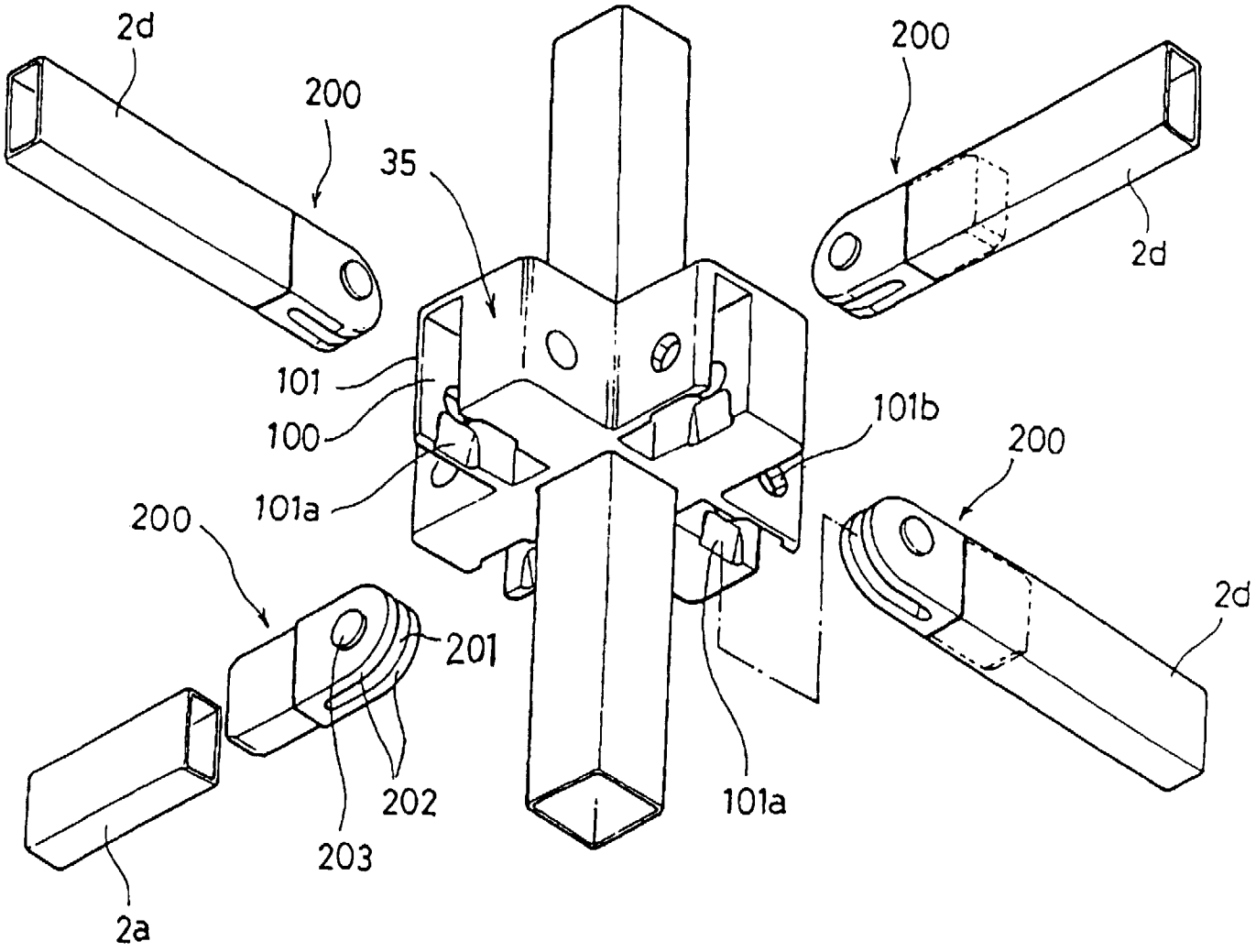
FIG. 8 is an exploded perspective view showing the second slidable mount and a plurality of connection members attached to the respective scissor bars for hinging the scissor bars to the sockets of the mount according to this invention.

As shown in FIG. 8, a connection member 200 is attached to the end of each scissor bar and hinges the scissor bar to the socket of the mount. The exposed end of the connection member 202 is axially slitted to a depth thus forming a channel-type slit 201, with resilient sidewalls 202 being formed on opposite sides of the slit 201 and being jointed by means of a web. The outside surface of each resilient sidewall 202 is provided with a boss 203, which is to be guided by the guide depression 101*a* and elastically snapped into the bore 101*b* of the mount when the scissor bar is jointed to the mount.

Figure 9:
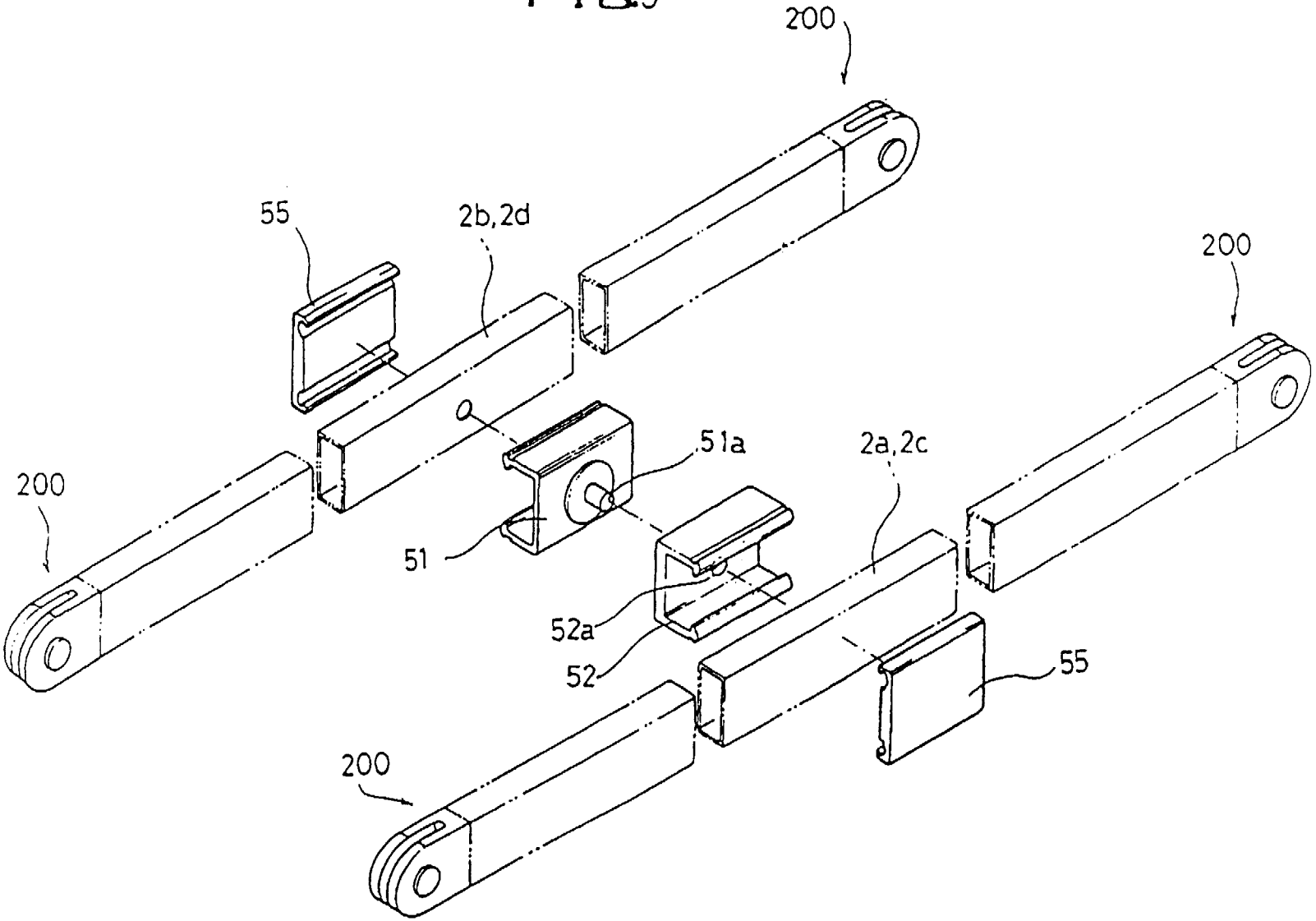
FIG. 9 is an exploded perspective view showing the a hinged joint of an edge scissor assembly according to this invention.

One hinged joint 50, which hinges the first and second scissor bars 2*a* and 2*b* together into an edge scissor assembly or hinges the third and fourth scissor bars 2*c* and 2*d* together into a roof scissor assembly, is shown in FIG. 9. As shown in the drawing, each hinged joint 50 comprises two back-to-back channel members 51 and 52 and two tightening covers 55. The first channel member 51, which is attached to the inside wall of one scissor bar of a scissor assembly, has a hinge pin 51*a*. Meanwhile, the second channel member 52, which is attached to the inside wall of the other scissor bar of the scissor assembly, has a hinge hole 52*a* which engages with the hinge pin 51*a*. The two tightening covers 55 are attached to the outside walls of the two scissor bars and integrate the channel members 51, 52 and the scissor bars into the scissor assembly.

In order to assemble the above-described elements into the framework, the first slidable mounts 15 are movably fitted over the respective support members 1*a* to 1*d* prior to attaching the first stationary mounts 10 to the top ends of the support members. In this case, the sockets of the first stationary mounts 10 have to be oriented in the direction corresponding to the sockets of the first slidable mounts 15.

Thereafter, two channel members 51 and 52 are attached to the inside walls of the first and second scissor bars 2*a* and 2*b* at the central portions of the bars. The channel members 51 and 52 in turn engage with the tightening covers 55 so that the bars 2*a* and 2*b* are tightly covered with channel members and tightening covers. Thereafter, the hinge pin 51*a* of the first channel member 51 is coupled to the hinge hole 52*a* of the second channel member 52, thus assembling the scissor bars 2*a* and 2*b* into an edge scissor assembly. Two connection members 200 are attached to each end of each scissor bar 2*a*, 2*b*, respectively. As described above, each of the connection members 200 has the channel type slit 201, resilient sidewalls 202 formed on opposite sides of the slit 201 and the boss 203 provided on the outside surface of each resilient sidewall 202.

After forming the edge scissor assemblies using the first and second bars 2*a* and 2*b*, the bars 2*a* and 2*b* are hinged to the mounts 15 and 10 respectively. In this case, the connection member 200 of each first bar 2*a* is fitted into the socket 100 of each first slidable mount 15 and is forcibly pushed into the socket 100, with the bosses 203 of the connection member 200 being guided by the guide depressions 101*a* of the mount 15. The bosses 203 of the connection member 200 are thus snapped into the bores 101*b* of the mount 15 and thereby hinge the first bar 2*a* to the mount 15. In the same manner, the second bars 2*b* are hinged to the first stationary mounts 10.

After hinging the first and second bars 2*a* and 2*b* to the mounts 15 and 10 of the upright support members 1*a* to 1*d*, the other end of each second bar 2*b* is hinged to the lower joint mount 25, while the other end of each first bar 2*a* is hinged to the upper joint mount 20.

The third and fourth scissor bars 2*c* and 2*d* are hinged together prior to attaching the connection members 200 to the bars 2*c* and 2*d* in the same manner as described for the bars 2*a* and 2*b*, thus forming the roof scissor assemblies. Thereafter, the second stationary mount 30 of the center post 3 is commonly connected to the upper joint mounts 20 through the third scissor bars 2*c* of the roof scissor assemblies. Similarly, the second slidable mount 35 of the center post 3 is commonly connected to the lower joint mounts 25 through the fourth scissor bars 2*d* of the roof scissor assemblies so that the framework of this invention is completely assembled. In this case, the third and fourth bars 2*c* and 2*d* are hinged to the mounts 20, 25, 30, 35 in the same manner as described for the first and second bars 2*a* and 2*b*. While assembling the elements into the framework, the scissor bars 2*a* to 2*d* are easily and quickly hinged to associated mounts 10, 15, 20, 25, 30 and 35 due to the resilient structure of the sidewalls 101 and 202. After assembling the framework, the framework is erected into a fully-expanded state on a support surface prior to covering the framework with a flexible covering.

In order to disassemble the framework into a stored state, the flexible covering is removed from the expanded framework prior to removing the bars 2*a* to 2*d* of the scissor assemblies from associated mounts 10, 15, 20, 25, 30 and 35. In this case, the bars 2*a* to 2*d* are easily and quickly removed from associated mounts due to the resilient structure of the sidewalls 101 and 202. After removing the scissor assemblies from the mounts, the scissor assemblies are disassembled into the separated bars 2*a* to 2*d* by disassembling the hinged joints 50.

As described above, the present invention provides a quick assembly tent framework. The framework is easily and quickly assembled or disassembled without using any tools thus being convenient to users.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A quick assembly tent framework comprising, a plurality of upright support members, a plurality of first and second scissor bars forming separable edge scissor assemblies through a plurality of upper and lower joint mounts and detachably connecting the upright support members together through a plurality of first stationary and slidable mounts, a center post supporting the top center of a flexible covering of a tent and having second stationary and slidable mounts, a plurality of third and fourth scissor bars forming roof scissor assemblies and connecting the second stationary and slidable mounts to the upper and lower joint mounts thus holding the center post, wherein each of said mounts is provided with a channel type socket for holding one end of an associated scissor bar, said socket being eccentrically formed on each mount with thick and thin sidewalls being formed on opposite sides of the socket, said thin sidewall being resilient thus elastically opening the socket when the scissor bar is hinged to the mount, each of said thick and thin sidewalls having a hinge bore and a hinge guide depression, said guide depression extending from an edge of each sidewall to the edge of the hinge bore; and two connection members are attached to both ends of each scissor bar in order to hinge each scissor bar to sockets of associated mounts, each of said connection members being axially slit to a depth thus forming a channel slit with resilient sidewalls being formed on opposite sides of said slit, each of said resilient sidewalls having a boss on its outside surface, said boss being guided by the guide depression and elastically snapped into the hinge bore when each scissor bar is jointed to an associated mount.

2. The quick assembly tent framework according to claim 1, wherein each of said edge and roof scissor assemblies is formed by hinging two scissor bars together at central portions of the bars using a hinged joint, said hinged joint comprising:

two back-to-back channel members, one of said channel members being attached to the inside wall of one scissor bar of each scissor assembly and having a hinge pin and the other being attached to the inside wall of the other scissor bar and having a hinge hole, said hinge hole engaging with said hinge pin; and two tightening covers attached to the outside walls of the two scissor bars of each scissor assembly and integrating the two channel members and the two scissor bars into each scissor assembly.

* * * * *